United States Patent [19]

Hitzman

[11] Patent Number: 4,518,489

[45] Date of Patent: May 21, 1985

[54] OIL TREATMENT

[75] Inventor: Donald O. Hitzman, Bartlesville, Okla.

[73] Assignee: Phillips Petroleum Company, Bartlesville, Okla.

[21] Appl. No.: 421,226

[22] Filed: Sep. 22, 1982

Related U.S. Application Data

[63] Continuation-in-part of Ser. No. 304,502, Sep. 22, 1981, abandoned.

[51] Int. Cl.[3] ..... C10G 17/00; C10G 17/04; C10G 17/08

[52] U.S. Cl. ..... 208/223; 208/208 R; 208/251 R; 208/252; 208/254 R

[58] Field of Search ..... 208/208 R, 223, 251 R, 208/252, 254 R

[56] References Cited

U.S. PATENT DOCUMENTS

| | | | |
|---|---|---|---|
| 3,410,906 | 11/1968 | Simpson et al. | 260/585 |
| 3,627,478 | 12/1971 | Tepper | 23/2 |
| 3,719,587 | 3/1973 | Karchmer et al. | 208/254 R |
| 3,915,842 | 10/1975 | Gatsis | 208/251 H |
| 4,060,479 | 11/1977 | Barcellos | 208/11 R |
| 4,108,760 | 8/1978 | Williams et al. | 208/11 LE |
| 4,112,050 | 9/1978 | Sartori et al. | 423/232 |
| 4,112,051 | 9/1978 | Sartori et al. | 423/228 |
| 4,112,052 | 9/1978 | Satori et al. | 423/228 |
| 4,151,068 | 4/1979 | McCollum et al. | 208/253 |
| 4,163,709 | 8/1979 | Bark et al. | 208/252 |
| 4,187,910 | 2/1980 | Cornelius | 166/305 R |
| 4,191,639 | 3/1980 | Audeh et al. | 208/251 R |
| 4,228,002 | 10/1980 | Vaidganathan et al. | 208/251 R |
| 4,268,378 | 5/1981 | Compton | 208/254 R |
| 4,272,361 | 6/1981 | Compton | 208/282 |
| 4,332,675 | 6/1982 | Basset | 208/254 R |
| 4,332,676 | 6/1982 | Basset | 208/254 R |
| 4,381,993 | 5/1983 | Nevitt | 208/260 |
| 4,392,948 | 7/1983 | Debande | 208/254 R |
| 4,425,225 | 1/1984 | Bearden et al. | 208/252 |
| 4,428,828 | 1/1984 | Bose | 208/208 R |
| 4,430,206 | 2/1984 | Rankel | 208/252 |

FOREIGN PATENT DOCUMENTS

| | | | |
|---|---|---|---|
| 1197706 | 9/1977 | U.S.S.R. | 208/208 R |

*Primary Examiner*—Delbert E. Gantz
*Assistant Examiner*—Helane Myers
*Attorney, Agent, or Firm*—A. W. Umphlett

[57] ABSTRACT

Basic nitrogen-containing compounds are removed from mineral oil, such as shale oil, by extraction with an immiscible aqueous phase containing an acid gas such as carbon dioxide. Effectiveness of the separation is proportional to the partial pressure of the gas. In one embodiment, a waste gas stream is used as the $CO_2$-containing gas.

21 Claims, No Drawings

OIL TREATMENT

This application is a continuation-in-part of copending application Ser. No. 304,502, filed Sept. 22, 1981 now abandoned.

This invention relates to the purification of mineral oils and other carbon-containing materials containing undesirable contaminants. In accordance with another aspect, this invention relates to the extraction of mineral oils to remove therefrom nitrogen-containing compounds and other impurities by extraction. In another aspect, this invention relates to the use of a $CO_2$ or other acidic gases as extractants for the removal of contaminants from various organic compositions containing same.

In still another aspect, the invention deals with the treatment of highly complex carbonaceous materials in order to recover nitrogen-containing substances, e.g., enzymes.

There is an ever present need for the treatment of various carbonaceous compositions to remove undesirable components therefrom. Many expedients have been advanced to treat various oil fractions. The present invention is directed to an improved process for the treatment of oils and other organic compositions containing nitrogen-containing compounds and undesirable contaminants, to render the oils and/or the nitrogen-containing compounds more desirable. The instant process finds utility, for example to treat various mineral oils prior to catalytic treatment, for example catalytic hydrotreating, thereby reducing consumption of hydrogen during hydrodenitrogenation. It also finds utility for the separation of proteins and other nitrogenous substances from compositions containing them.

Accordingly, an object of this invention is to provide an improved process for the purification of mineral oils.

Another object of this invention is to provide an improved process for the purification of nitrogenous substances.

A further object of this invention is to provide an extractant to remove undesirable contaminants from mineral oils and from organic compositions containing desirable nitrogen-containing compounds.

A further object of this invention is to provide an economically feasible process for the removal of undesirable constituents from mineral oils and from mixtures which contain desirable nitrogenous substances.

Other objects, aspects, as well as the several advantages of the invention will be apparent to those skilled in the art upon reading the specification and the appended claims.

In accordance with one aspect of the invention, nitrogen-containing compounds as well as other contaminants are removed from oils containing same by extraction with an immiscible aqueous phase containing an acid gas, such as carbon dioxide.

In accordance with another aspect, the contacting of acid gases with compositions including nitrogen-containing substances, such as crude proteins, natural products, coals, and the like, serves to fractionate and purify those substances.

It has been further found, according to the invention, that the effectiveness of the separation is proportional to the partial pressure of the gas.

In accordance with a specific embodiment, shale oil is treated with aqueous carbon dioxide to remove a substantial fraction of the nitrogen-containing compounds originally present in the oil. Significant amounts of arsenic and other heavy metals as well as sulfur-containing compounds associated with the nitrogenous compounds can also be removed, according to the invention.

In one specific embodiment, a shale oil is treated in the presence of a water phase at about 500 to about 1100 psig $CO_2$ pressure and the water phase formed is removed under pressure and contains nitrogen, sulfur, metals, and other contaminants.

In another embodiment, the use of carbon dioxide under pressure in aqueous phase functions as a means to solubilize a variety of nitrogen containing compounds.

In a specific embodiment, the enzyme catalase is recovered in much higher yield by solubilizing under $CO_2$ pressure vs. $N_2$ pressure before filtering to remove solid impurities. Equivalent aqueous samples treated under $N_2$ or $CO_2$ atmospheres at 50 psig gave 13 vs. 828 units of activity after filtration. In yet another embodiment, acidic gases are used to fractionate and purify mixtures of amine (amino) containing compounds by the following process. The amine containing mixtures to be separated are added to an aqueous (or solvent) phase and the gas (e.g., $CO_2$) added under pressure (from 1–100 atms). In one process the $CO_2$ pressure is increased so that all of the amine compounds are solubilized. The pressure is then released incrementally such that each different amine compound is precipitated at a different pressure and the separated precipitated product is removed from the remaining solubilized amine compounds.

Another embodiment of this invention comprises contacting the organic mixture to be treated with a solution of acid gas in water, e.g., aqueous carbonic acid. Any method that provides intimate mixing between immiscible liquid phases is suitable. The contacting can be done batchwise or it can be continuous. Although conditions for the contacting process can vary considerably, a primary objective is to bring a sufficient concentration of acid gas into the organic phase to cause at least some of the nitrogen-containing compounds to be removed from that phase, in the presence of liquid water that assists in the separation. The separation can involve dissolution of compounds into the aqueous phase, or it can involve formation of a third phase—solid or liquid—that is insoluble in either the organic portion or the water.

The conditions for carrying out the instant process can vary appreciably with respect to contacting temperatures, extractant pressures, contact time, oil-to-water ratios, and the like. In general, the treatment of the oil or other organic compositions is carried out under conditions sufficient to effect suitable contacting, including reaction conditions, that will remove any desirable or undesirable nitrogen-containing substances, as well as various metals and contaminants, from the compositions being treated. Specifically, to effect the process of this invention, from about 0.01 to 5 volumes of untreated organic material, e.g., oil, per unit volume of water are contacted. Preferably, when oil is treated, 0.2 to 2 volumes of oil per volume of water are contacted. When nitrogenous compounds are desired, the ratio of volumes of the impure composition, e.g., crude protein, to the volume of water is preferably about 0.01 to about 0.1.

Suitable temperatures for this process are those at which water is in the liquid phase. Thus, temperatures from the ice point to the boiling point of water can be used. However, the viscosity of the oil during the process must also be considered. The temperature should be high enough to permit good contacting between the immiscible phases; hence, it will generally be at least higher than the pour point of the oil. Temperatures between about 20°–90° C. are preferred.

The acid gases useful herein are organic or inorganic compounds which have chemical affinities for nitrogenous substances. Useful reagents include carbon dioxide, hydrogen sulfide, sulfur dioxide, sulfur trioxide, hydrogen cyanide, and the like. Carbon dioxide is preferred. Mixtures of acid gases can be used.

The partial pressure of acid gas during the contacting process can range from about one to about 100 atmospheres, or even higher. The gas that is used in combination with the liquid phases, e.g., water and/or solvent, should contain at least about 20 mole percent of acid gas—preferably it will contain more than 50 mole percent thereof. Up to five mole percent of oxygen in the gas is permissible, but preferably it will contain not more than one mole percent. Convenient sources of carbon dioxide-containing gas are flue gas, fermentation off-gas, and the like. Carbon dioxide-nitrogen mixtures are very appropriate.

Suitable contact times between the immiscible phases will depend, e.g., upon volumetric ratios, the pressure of acid gas, dispersion of the two phases, etc. Generally, the time will be at least one minute, but an hour or more may be used to approach equilibrium solubilities. Additional recovery of nitrogen-containing compounds can be accomplished by repeated contacting of the composition to be treated under the conditions of the invention.

Organic compositions suitable for treatment by the process of this invention are any comprising nitrogen-containing compounds, particularly primary, secondary, and tertiary amines and heterocyclic compounds, such as pyrrole, pyridine, indole, quinoline, etc., and their derivatives. One preferred group of compositions are those containing amino acids and/or peptides, i.e., proteins and enzymes. Contaminants such as sulfur-containing compounds, metals such as arsenic, nickel, and vanadium, etc., sometimes associated with the nitrogenous compounds can be removed according to the invention.

Oil based materials to be treated include shale oil, petroleum, and liquid products from tar sands and coal and lignite liquefaction. Treatment of shale oil having relatively high nitrogen content is a presently preferred application.

Oils treated as disclosed here are slightly diminished in quantity by partial dissolution in the aqueous phase or by formation of insoluble material that tends to collect at the oil-water interface. Material dissolved in the water may be removed from solution when the water is separated from the oil and its acid gas content reduced. Insolubles that collect at the interface may be separated by filtration, decantation, or other appropriate procedures.

In order to recover the desired product, the acid gas containing phase is removed or separated by suitable physical methods such as decantation and the like. Alternatively, the phase from which the acid gas extractable components have been removed in accordance with the invention can be physically separated via suitable techniques.

When one or more nitrogen-containing substances are the desired products, the compositions to be treated include crude mixtures containing, e.g., proteins, amino acids, or amines. Enzymes, such as catalase, are preferred nitrogen-containing substances which can be recovered according to the process of the invention.

One preferred method for the recovery of several nitrogenous compounds involves the use of a water or solvent solution of a mixture of nitrogen-containing substances. Acid gas is added under suitable pressure, e.g., from about 1 to about 100 atmospheres such that essentially all of the nitrogen-containing substances present are solubilized. The pressure is then decreased in a stepwise fashion so that, in accordance with the solubilities of the nitrogen substances, they are released as the pressure decreases.

Alternatively, the process can be reversed, i.e., the pressure can be increased with different nitrogen compounds separating with each pressure increase. Crude mixtures containing amines (proteins, enzymes, amino acids, tertiary amines, diamines, etc.) are thus fractionated by taking advantage of the fact that only a part of the mixtures is soluble at a given acid gas pressure and that some of this solubilized material will precipitate after acid gas removal.

The process can be carried out in cascade, tray, scrubber, or countercurrent reactors. Since the gas is recycled, the separation is simple and cheap. When using $CO_2$ on such compounds as proteins and enzymes, the $CO_2$ can bind the amino groups to form carbamates which help stabilize the proteins by crosslinking and permit internal crosslinking. In addition, the process can incorporate reactants in the system such that the solubilized compound can then enter a chemical reaction with another added compound and thus is selectively reacted to prepare a secondary product which is readily separated. The process is versatile enough to selectively remove amine containing compounds from various mixtures, i.e., cells, gases, solids, and can be used in non-aqueous solvents if desired.

The process of this invention is illustrated by the following examples.

EXAMPLE I

Equal volumes of shale oil and water were placed in a high pressure (Jerguson) cell having 0.14 liter capacity that was maintained at 100° F. (37.8° C.). Liquid circulation in the cell was maintained with a pump that drew liquid from the lower (water) phase and returned it to the gas phase above the oil in the cell. An atmosphere of carbon dioxide was maintained in the cell, starting at about 0 psig, then increasing in increments of about 100 psig until a maximum pressure of 1600 psig was reached. At each pressure, water circulation continued for 2.5 hours, then samples from the water phase and the oil phase were removed under pressure, centrifuged, and analyzed for nitrogen, sulfur, and arsenic.

Results from these runs show that removal of these elements from oil increases with pressure of carbon dioxide up to about 1300 psig; higher pressure has relatively small effect. A portion of the extracted compounds was dissolved in the aqueous layer. Thus, at about 1300 psi pressure, approximately 40% of the original N, 20% of the S, and 10% of the As were extracted. Essentially all of the arsenic that was extracted from the oil appeared in the water.

EXAMPLE II

Total Paraho shale oil and fractions of it obtained by distillation, and Monagas Pipeline (Venezuela Group II crude diluted with a few percent of diesel fuel to reduce viscosity for No. 6 fuel oil) were extracted with aqueous carbonic acid in a stirred one-liter reactor. All of these runs were made at 500 psig at a temperature between 27°-37° C. with 150 mL of oil and 750 mL of water. Carbon dioxide was supplied to the reactor on demand, and runs continued for one hour after the demand ceased—total run time between 2-4 hours. Samples of the oil after extraction were analyzed for nitrogen, sulfur, and arsenic. Results of these runs are summarized in Table I. Columns under the elements show the concentration of that element in the oil before extraction. In parentheses below each value is shown the percent of element removed from the oil by the extraction.

TABLE I

| Run | Oil | Nitrogen | Sulfur | Arsenic |
|---|---|---|---|---|
| I | Total Paraho | 1.89 wt. % (25.1) | 0.83 wt. % (8.0) | 37.7 ppm (26) |
| II | 200-300° F. Paraho | 0.36 wt. % (71.0) | 0.93 wt. % (22.2) | 7.6 ppm (50) |
| III | 400-500° F. Paraho | 1.41 wt. % (32.9) | 0.52 wt. % (2.4) | 31.1 ppm (16) |
| IV | 650-1000° F. Paraho | 2.25 wt. % (5.6) | 0.4 wt. % (4.7) | 22.3 ppm (35) |
| V | 650+° F. Paraho | 2.07 wt. % (10.4) | 0.6 wt. % (−21)* | 28 ppm (2) |
| VI | Monagas pipeline | 0.26 wt. % (25) | 2.89 wt. % (19.5) | 0.10 ppm (5) |

*Appeared to increase in sulfur concentration. Considered to be experimental error.

Treatment according to the method of this invention is effective to remove a significant fraction of nitrogen contained in these oils.

EXAMPLE III

A sample of the oil used in Run II of Example II was extracted as above, but with water only. In that run, only 45 percent of the nitrogen was removed, as compared with 71.0 percent removal in the run made according to this invention.

EXAMPLE IV

Two dilute solutions of beef liver catalase (Sigma C100, 36,000 U/mg protein) were prepared by adding 0.25 ml of enzyme to 25 mL of deionized water. The samples were treated at room temperature under about 60 psig of either nitrogen or carbon dioxide gas with stirring for about 30 minutes. Samples were then filtered and evaporated to dryness, the residue weighed and assayed for enzyme activity.

| Treatment | Dry Weight Recovered, g | Activity, U |
|---|---|---|
| $N_2$ | 0.0034 | 13 |
| $CO_2$ | 0.0059 | 828 |

This example demonstrates that nearly twice as much material was solubilized upon treatment with a $CO_2$ atmosphere compared to an inert atmosphere such as nitrogen. In addition, the catalase activity of the $CO_2$ treated sample is several hundred times higher than the activity of the nitrogen treated sample.

EXAMPLE V

Two solutions of soy bean protein were prepared by adding 0.1 g protein to 100 mL deionized water. Samples were stirred at room temperature for about 30 minutes under 60 psig of nitrogen or $CO_2$ gas. Samples were then passed through a 4.5 micron Millipore filter and 10 mL of filtrate placed in an open dish to air dry. After 20 hours, the dried samples were weighed and analyzed for the presence of amino acids.

| Treatment | Recovered | Amino Acid Analysis |
|---|---|---|
| $N_2$ | 0.0023 | none |
| $CO_2$ | 0.0019 | none |

This example indicates that there is an insignificant difference in employing an inert atmosphere such as nitrogen, and a $CO_2$ atmosphere for separation of nitrogen containing compounds from a crude protein product at low pressures.

Reasonable variations as would occur to the skilled artisan may be made herein without departing from the scope of the invention.

I claim:

1. A process for treating hydrocarbon oils in order to separate nitrogenous substances, as well as other contaminants, therefrom which comprises (1) contacting the oil in the presence of water with an acid gas which has an affinity for nitrogenous substances under conditions including temperature in the range of about 20° to about 90° C., sufficient pressure and contacting with an immiscible phase chosen from water, immiscible solvent or mixtures thereof effective to provide removal of nitrogen-containing compounds, and (2) separating said immiscible phase containing nitrogen-containing compounds from the hydrocarbon oils.

2. A process according to claim 1 wherein said oil is a crude shale oil.

3. A process according to claim 1 wherein the amount of hydrocarbon oil per unit volume of water is in the range of from about 0.01 to about 5 volumes.

4. A process according to claim 1 wherein the acid gas is selected from the group consisting of carbon dioxide, hydrogen sulfide, sulfur dioxide, sulfur trioxide, hydrogen cyanide and mixtures thereof.

5. A process according to claim 4 wherein said pressure is an elevated pressure sufficient to provide liquid phase conditions and the gas contains at least about 20 mole percent acid gas.

6. A process according to claim 4 wherein the acid gas is $CO_2$.

7. A process according to claim 6 wherein said $CO_2$ is present in a $CO_2$-containing combustion waste stream and said hydrocarbon oil is shale oil whereby the waste stream is purified at the same time as the shale oil is upgraded.

8. A process according to claim 1 wherein said oil is treated at about atmospheric to about 100 atmospheres $CO_2$ pressure.

9. A process according to claim 8 wherein said oil is shale oil.

10. A process for removing nitrogen compounds and contaminants including sulfur and metals from hydrocarbon oils which comprises contacting said compositions with aqueous acid gas which has an affinity for nitrogenous substances under extraction conditions of temperatures in a range of about 20° C. to about 90° C. at an elevated pressure sufficient to form a liquid water extract phase containing solubilized nitrogen-containing compounds and contaminants, removing said extract phase containing said compounds, and separating acid gas from said composition reduced in contaminants content.

11. A process according to claim 10 wherein said oil is shale oil and said pressure ranges from about atmospheric to about 100 atmospheres.

12. A process according to claim 10 wherein the acid gas is selected from the groups consisting of carbon dioxide, hydrogen sulfide, sulfur dioxide, sulfur trioxide, hydrogen cyanide and mixtures thereof.

13. A process according to claim 12 wherein the acid gas is $CO_2$.

14. A process according to claim 13 wherein said $CO_2$ is present in a $CO_2$-containing waste stream and said oil is shale oil whereby the waste stream is purified at the same time as the shale oil is upgraded.

15. A process according to claim 14 wherein said $Co_2$-containing stream contains at least about 20 mole percent $Co_2$.

16. A process according to claim 13 wherein said oil is Monagas crude.

17. In a combination process wherein crude shale oil is contacted by the process of claim 13 with an immiscible aqueous phase containing $CO_2$ to remove nitrogen, and other contaminants including sulfur and metals, such as arsenic, nickel and vanadium, wherein the $CO_2$-containing gas is thereby separated into purified streams enriched in $N_2$ and $CO_2$, the improvement which comprises using a $CO_2$-containing waste gas stream so that the waste gas stream is purified at the same time as the shale oil is upgraded.

18. A process according to claim 17 wherein said oil is treated at about atmospheric to about 100 atmospheres $CO_2$ pressure.

19. In a combination process wherein a hydrocarbon oil containing one or more recoverable nitrogenous substances is contacted by the process of claim 13 with $CO_2$-containing gas in the presence of water to remove those substances and wherein the $CO_2$-containing gas is separated into purified streams enriched in $N_2$ and $CO_2$, the improvement which comprises using a $CO_2$-containing waste gas stream so that the waste gas stream is purified at the same time as the nitrogenous substances are recovered.

20. A process according to claim 16 wherein said hydrocarbon oil is treated in the presence of a water phase at about atmospheric to about 100 atmospheres $CO_2$ pressure.

21. A process according to claim 20 wherein the nitrogenous substances removed include at least one selected from the group consisting of primary, secondary, and tertiary amines and nitrogen-containing heterocylic compounds.

* * * * *